US011534656B2

(12) United States Patent
Smits

(10) Patent No.: US 11,534,656 B2
(45) Date of Patent: Dec. 27, 2022

(54) BICYCLE TRAINING SYSTEM WITH IMPROVED MOTION

(71) Applicant: Tacx B.V., Wassenaar (NL)

(72) Inventor: Martin Smits, Wassenaar (NL)

(73) Assignee: Tacx B.V., Oegstgeest (NL)

( * ) Notice: Subject to any disclaimer, the term of this patent is extended or adjusted under 35 U.S.C. 154(b) by 0 days.

(21) Appl. No.: 16/892,847

(22) Filed: Jun. 4, 2020

(65) Prior Publication Data

US 2021/0146192 A1 May 20, 2021

Related U.S. Application Data

(60) Provisional application No. 62/937,972, filed on Nov. 20, 2019.

(51) Int. Cl.
*A63B 22/06* (2006.01)
*A63B 21/005* (2006.01)

(52) U.S. Cl.
CPC ..... *A63B 22/0605* (2013.01); *A63B 21/0058* (2013.01); *A63B 2022/0641* (2013.01)

(58) Field of Classification Search
CPC ... A63B 22/06–0605; A63B 2022/0611–0658; A63B 69/16; A63B 2069/161–168; A63B 22/14–16
See application file for complete search history.

(56) References Cited

U.S. PATENT DOCUMENTS 2,972,478 A * 2/1961 Raines ..... A63B 69/16 482/61
4,743,012 A * 5/1988 Kim ..... A63B 22/16 434/61
5,549,527 A * 8/1996 Yu ..... A63B 21/00196 482/57
6,648,802 B2 * 11/2003 Ware ..... A63B 21/015 482/57

(Continued)

FOREIGN PATENT DOCUMENTS

EP 2319592 A1 5/2011
EP 3513844 A2 7/2019

OTHER PUBLICATIONS

Printout from https://saris.com/product/mp1, published prior to Jun. 4, 2020.

*Primary Examiner* — Nyca T Nguyen
(74) *Attorney, Agent, or Firm* — Samuel M. Korte; Max M. Ali

(57) ABSTRACT

A direct-drive bicycle training system and methods of using the same are provided. The system includes a bicycle trainer that rests on a support surface and supports a bicycle frame in an upright manner with respect to the support surface. The bicycle trainer includes a stator, a rotor that rotates with respect to the stator, a cassette affixed to the rotor, a support frame supporting the stator, rotor, and cassette, and a resistance applying mechanism that operatively couples to a portion of a drivetrain of the bicycle frame and applies varying levels of resistance to the portion of the drivetrain.

(Continued)

The support frame moves with respect to the support surface in response to a force applied to the drivetrain of the bicycle frame during use of the bicycle training system, generating a more natural movement of the bicycle and simulating on-road use.

8 Claims, 9 Drawing Sheets

(56) References Cited

U.S. PATENT DOCUMENTS

| | | | | |
|---|---|---|---|---|
| 6,659,917 | B1 * | 12/2003 | Tacx | A63B 69/16 482/63 |
| 8,636,629 | B2 * | 1/2014 | Zwinkels | A63B 69/16 482/61 |
| 10,112,098 | B2 * | 10/2018 | Smits | A63B 69/16 |
| 10,576,348 | B1 * | 3/2020 | Hawkins, III | A63B 71/0622 |
| 2005/0008992 | A1 * | 1/2005 | Westergaard | A63B 24/00 434/61 |
| 2010/0125029 | A1 * | 5/2010 | Nielson | A63B 22/0605 482/61 |
| 2011/0281693 | A1 * | 11/2011 | Arstein | A63B 21/00192 482/57 |
| 2011/0287902 | A1 * | 11/2011 | Bingham, Jr. | A63B 21/00069 482/61 |
| 2017/0128764 | A1 * | 5/2017 | Hsu | A63B 21/4034 |
| 2018/0161627 | A1 * | 6/2018 | Dhawan | A63B 24/0075 |
| 2018/0326255 | A1 * | 11/2018 | Schranz | A63B 22/0046 |
| 2018/0339211 | A1 | 11/2018 | Coberly et al. | |
| 2019/0022497 | A1 * | 1/2019 | Hawkins, III | A63B 24/0087 |
| 2019/0070456 | A1 | 3/2019 | Tung | |
| 2019/0070476 | A1 * | 3/2019 | Bass | A63B 69/16 |
| 2020/0122011 | A1 | 4/2020 | Papadopoulos | |

* cited by examiner

BICYCLE TRAINING SYSTEM WITH IMPROVED MOTION

CROSS-REFERENCE TO RELATED APPLICATION

This non-provisional application claims the benefit of priority of U.S. Provisional Application No. 62/937,972, filed Nov. 20, 2019, and titled "Bicycle Trainer with Improved Motion," which is incorporated by reference herein in its entirety.

BACKGROUND

Bicycle trainers are often used by cyclists and others for training purposes. Such trainers allow cyclists to exercise and train while remaining generally stationary, typically indoors. Trainers may include an integrated bicycle (e.g., handlebars, seat, and pedals) or else be configured to attach to a cyclist's existing bicycle. For example, some trainers include rollers or sliders upon which a cyclist may place the rear wheel of their bicycle. Other trainers apply resistive or magnetic force to the bicycle's captured rear wheel. And still other trainers, known as "direct-drive" trainers, enable a cyclist to remove the rear wheel of the bicycle frame and directly attach the frame and drivetrain of the bicycle to the trainer.

Often such trainers will provide varying levels of resistance on the bicycle's pedals during a training session to simulate a cyclist going up or down a hill, to simulate ambient conditions such as head or tail winds, or to otherwise alter the training difficulty level in response to the cyclist's input. However, because in these known trainers the bicycle frame is held generally stationary on the trainer, the cyclist's experience in responding to the varying levels of resistance is much different than would otherwise be experienced on the road. For example, when riding on the road, the bike frame will move, jump, or jerk in response to the cyclist suddenly applying increased force to the pedals when climbing a hill and thereafter seemingly recoil when the cyclist decreases force on the pedals while coasting or the like. But because the bicycle's wheels are fixed in place when using a trainer, the fixed frame provides an unnatural feel to the user as they increase or decrease their effort on the pedals. There thus remains a need for a bicycle trainer that provides an experience that more closely resembles the natural feel of riding on the road.

SUMMARY

Various embodiments of the invention relate to a trainer that is configured to generate forward and backward motion based on forces applied to the bicycle's pedals or as the cyclist shifts weight or otherwise interacts with the bicycle frame during a training session. This generates more natural movement for the cyclist while training the cyclist's muscles in a similar manner as if the cyclist were riding outside on the road. For example, when simulating a climb, the resistive forces in the trainer are relatively high and thus the forward and backward movement of the trainer will be similar as to a bicycle frame during a similar climb in on-road riding.

For example, some embodiments of the invention are directed to a direct-drive bicycle training system. The system includes a bicycle trainer that rests on a support surface and supports a bicycle frame in an upright manner with respect to the support surface. The bicycle trainer includes a stator, a rotor that rotates with respect to the stator, a cassette affixed to the rotor and that rotates with the rotor, a support frame supporting the stator, rotor, and cassette, and a resistance applying mechanism that operatively couples to a portion of a drivetrain of the bicycle frame and applies varying levels of resistance to the portion of the drivetrain. The support frame moves with respect to the support surface in response to a force applied to the drivetrain of the bicycle frame during use of the bicycle training system, generating a more natural movement of the bicycle and simulating on-road use.

Other aspects of the invention are directed to a method of training using a direct-drive bicycle training system. The method includes resting a bicycle trainer on a support surface, such as the bicycle trainer described above, and supporting a bicycle frame in an upright manner with respect to the support surface using the bicycle trainer. The method also includes operatively coupling a portion of a drivetrain of the bicycle frame to the bicycle trainer and applying varying levels of resistance to the portion of the drivetrain. In response to the varying levels of resistance a cyclist using the training system may move the bicycle frame during simulating movement of on-road use of the bicycle, and the method further includes moving the support frame with respect to the support surface in response to a force applied to the drivetrain of the bicycle frame.

BRIEF DESCRIPTION OF THE DRAWINGS

Embodiments of the present invention are described in detail below with reference to the attached drawing figures, in which like numerals represent the same components, and wherein.

DETAILED DESCRIPTION

Figure 1:
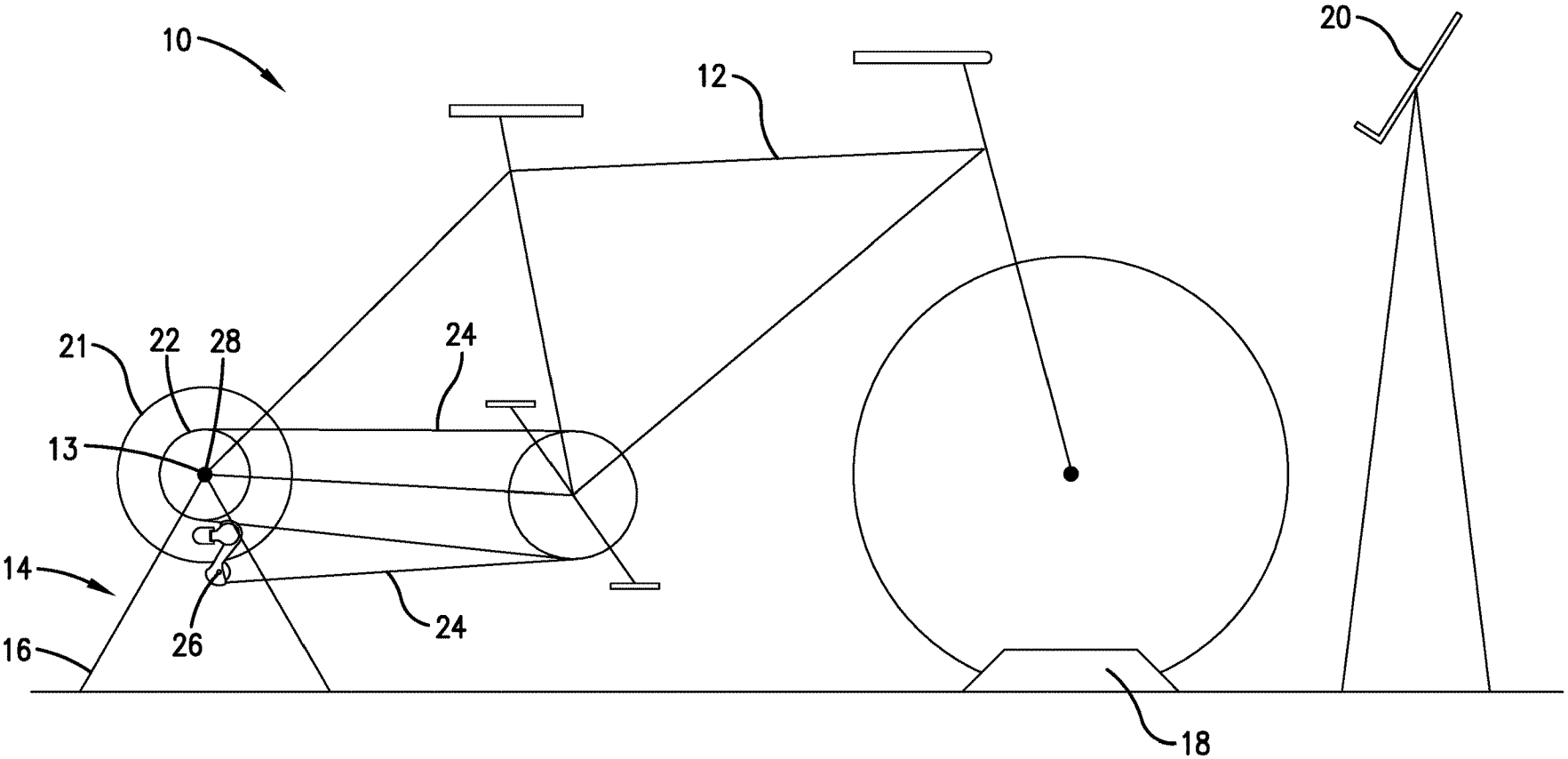
Fig. 1. PRIOR ART
FIG. 1 is a perspective view of a cyclist using a prior-art, direct-drive type bicycle training system.

FIG. 1 shows a prior-art, direct-drive bicycle training system 10 in which a bicycle is fixed in place. Unlike the instant invention, the prior art training system does not provide a cyclist dynamic feedback or real-world feel as the cyclist shifts gears, increases or decreases force on the pedals, or shifts their weight, thus failing to truly simulate the natural movement of a bicycle on the road. The bicycle training system 10 generally includes a bicycle frame 12 operatively coupled to a bicycle trainer 14. The bicycle trainer 14 includes a rear wheel dock 16, a front wheel dock 18, and a screen 20 that may simulate images of a road, trail, or other course being virtually ridden by a cyclist. The docks 16, 18 couple to one or more components of the bicycle frame 12 and permit interaction therewith. For example, the front wheel dock 18 engages and holds the front wheel of the bicycle frame 12 rigidly in place while the rear wheel dock 16 engages a frame portion proximate a rear axle 28 of the bicycle frame 12 and permits interaction between the bicycle frame 12's drivetrain and the bicycle trainer 14. More particularly, because the depicted bicycle trainer 14 is a "direct-drive" trainer, the rear wheel dock 16 engages the rear axle 28 of the bicycle frame 12 as well as components of the bicycle's drive train including, for example, the chain 24. Other prior art training systems may instead engage the rear wheel itself in a stationary but rotatable manner and apply increasing or decreasing force to the rear wheel during a training system.

To use the bicycle training system 10, a user removes the rear wheel and associated cassette from the bicycle frame 12, leaving the remaining portions of the drivetrain on the frame 12 including the chain 24 and a rear derailleur 26 attached to the frame 12. The front wheel of the bicycle frame 12 is fixedly engaged by the front wheel dock 18 via a clamp or similar mechanism. The rear of the bicycle frame 12 is connected to the rear wheel dock 16 via the rear axle 28. In some instances, the rear axle 28 may be the axel associated with the bicycle frame 12 that is used to hold the rear wheel rotatably in place when the bicycle frame 12 is outfitted for on-road use. In other instances, the rear axle 28 is an integral component of the bicycle trainer 14, and thus both the bicycle frame 12's rear wheel and rear axle are removed prior to use of the trainer, and the bicycle frame 12 is in turn affixed to the rear wheel dock 16 using the integrally provided axle 28.

In any event, the rear axle 28 affixes the rear portion of the bicycle frame 12, for example the rear dropouts 13 of the bicycle frame 12 or similar frame component, to the bicycle trainer 14 in a rotatable manner. When so affixed, the rear dropouts 13 are supported by the bicycle trainer 14 in such a way that a rotor 21 with attached cassette 22 of the trainer 14 can rotate between the stays of the bicycle frame 12, much like a rear wheel would rotate between the stays during on-road use. The chain 24 is engage with one sprocket of the cassette 22, much like the chain 24 would engage a sprocket of the cassette of the rear wheel of the bicycle frame 12 when used for on-road use. Thus, as a cyclist turns the pedals of the bicycle, the chain 24 translates the cyclist's motion to the rotor 21 because the chain 24 is engaged with a sprocket of the cassette 22, thereby spinning the rotor 21. As should be appreciated, the cyclist can switch between multiple sprockets on the rear cassette 22 by using a shifter lever mounted to the bicycle frame 12's handlebars, downtube, or other frame component, with the shifter lever being connected via a cable to the rear derailleur 26. The rear derailleur 26, in turn, shifts the chain 24 between the multiple sprockets, thereby changing the effective gear ratio between the rear cassette 22 and the crankset attached to the pedals and thus altering the amount of rotations of the rotor 21 per rotation of the pedals and thus crankset.

The bicycle trainer 14, and more particularly the rear wheel dock 16 of the trainer 14, includes an internal stator that increases or decreases the resistance on the rotor 21 via electromagnetics, generators, or similar mechanism, thereby simulating a hill or other ambient condition that the cyclist would encounter on a road. As increased or decreased effort is needed when the cyclist encounters a simulated hill or the like via increased resistance between the stationary stator and the spinning rotor 21, the cyclist can downshift or upshift, respectively, as they would do on the road. However, because the bicycle frame 12 is held firmly in place and cannot horizontally translate or otherwise dynamically respond to the cyclist's inputs, the bicycle frame 12 does not provide a real-world-like feedback to the cyclist as they increase or decrease effort, shift gears, and otherwise adapt to the varying resistance placed on the rotor 21.

Figure 2:
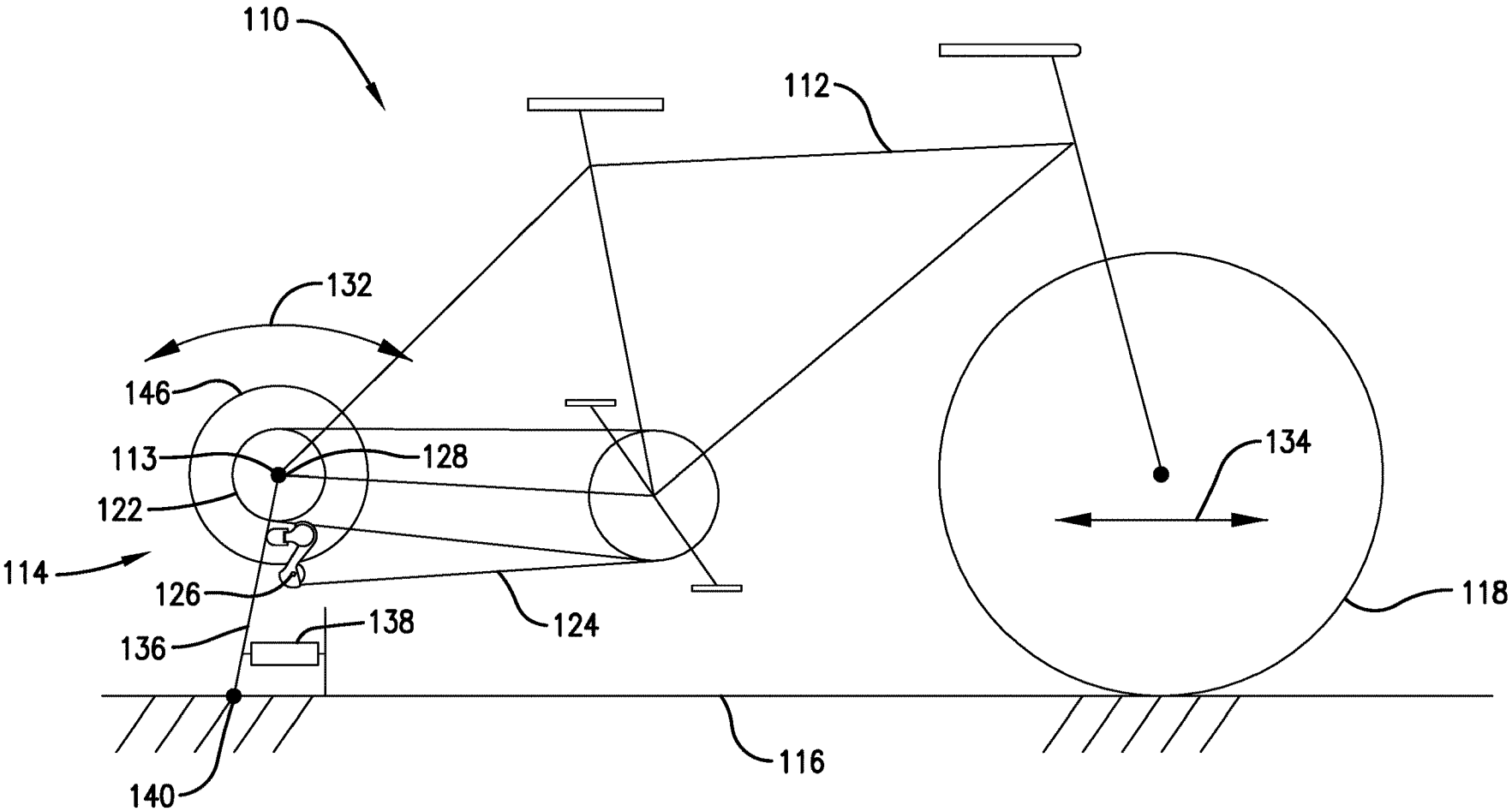
FIG. 2 is a right-side elevation view of a bicycle training system according to a first embodiment of the invention.
Figure 3B:
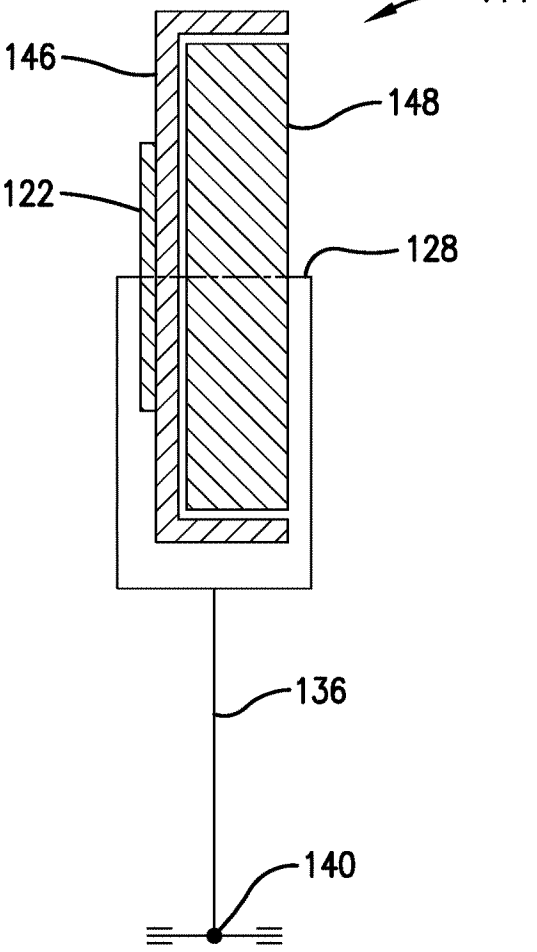
FIG. 3B is a front view of the portion of the bicycle trainer shown in FIG. 3A.

In contrast, embodiments of the instant invention provide a dynamic, on-road experience to a cyclist using a training system because the training system includes integral components that allow the bicycle frame to shift, pivot, or translate as the cyclist shifts gears, increases or decreases force on the pedals, or shifts their weight, thus simulating the natural movement of a bicycle on the road. Turning first to FIGS. 2-3B, a bicycle training system 110 according to a first embodiment of the invention is shown. Unlike the static bicycle training system 10 shown and described in connection with FIG. 1, the bicycle training system 110 shown in FIGS. 2-3B dynamically reacts to a cyclist's input by horizontally translating and pivoting the front and rear portions of a bicycle frame 112, respectively, thereby providing dynamic feedback to a cyclist using the training system 110 and thus more closely resembling an on-road experience.

In the depicted embodiment, the bicycle training system 110 is a direct-drive type training system and thus includes a bicycle frame 112 operatively coupled to a bicycle trainer 114 via a portion of the bicycle frame 112's drivetrain. More particularly, the bicycle trainer 114 operatively couples to a rear portion of the bicycle frame 112 while a front wheel 118 of the bicycle frame rests upon a support surface 116 and thus is permitted to freely roll thereupon. In other embodiments, the training system may include a front wheel dock that clamps to or otherwise engages the front wheel 118 and which includes near-frictionless rollers or the like that horizontally translate with respect to the support surface 116 without departing from the scope of the invention. The trainer 114 could also include additional components such as a screen or other user interface, similar to the screen 20 depicted in FIG. 1, which are not important for understanding aspects of the invention and thus have not been depicted in the figures. And in other embodiments, the bicycle trainer 114 may not be a direct-drive type trainer but may instead capture a rear wheel of the bicycle frame 112 via a series of rollers or similar without departing from the scope of the invention.

The front wheel 118 is allowed to freely roll about or otherwise horizontally translate with respect to the support surface 116 such that a front portion of the bicycle frame 112 is permitted to move forwards and backwards during use of the bicycle training system 110, as schematically depicted by arrow 134. Again, in some embodiments the front wheel may be clamped or otherwise secured in a translating sled or the like (not shown), while in other embodiments the front wheel itself may be permitted to roll back and forth along the surface resulting in the horizontal motion shown by arrow 134.

The bicycle trainer 114, which is configured to operatively couple to a rear portion of the bicycle frame 112, generally includes an integral rear cassette 122 coupled to a rotor 146, a support frame 136 pivotably mounted with respect to the support surface 116 via a rotating joint 140, and a spring and damper assembly 138. The bicycle trainer 114 engages a rear portion of the bicycle frame such as a rear axle 128, the rear dropouts 113 of the frame 112, and/or other portions of the stays of the bicycle frame 112. More particularly, to mount the bicycle frame 112 to the bicycle trainer 114, the cyclist removes a rear wheel and cassette of the bicycle frame 112, secures the a rear portion of the frame 112 (for example, the rear dropouts 113) to bicycle trainer 114 by inserting the rear axle 128 through the rear dropouts 113 and a central opening of trainer 114 and securing the axle 128 in place via a quick release lever or similar device known in the art, and then places the chain 124 around a sprocket of the rear cassette 122. Once mounted in this regard, the cyclist can translate the chain 124 among the sprockets of the rear cassette 122 of the trainer 114 during a training session via a shifter lever operatively connected to a rear derailleur 126 via a cable, as discussed above in connection with FIG. 1.

As schematically depicted by arrow 132, the bicycle trainer 114 supports the rear portion of the bicycle frame 112 in a pivotably manner with respect to the support surface 116. More particularly, the pivoting support frame 136 extends between a rotating joint 140 at a proximal end thereof and the rear axle 128 area of the bicycle frame 112 at the distal end thereof. In this regard, as a cyclist uses the bicycle training system 100, the bicycle frame 112 is permitted to dynamically respond to the cyclist's inputs on the pedals, weight shifts, and other changes during the training session by the rear portion of the frame 112 pivoting back and forth (arrow 132) and the front end of the frame horizontally translating back and forth (arrow 134).

For example, as the cyclist bears down on the pedals in order to increase speed, respond to an increase in resistance from the bicycle trainer 114, or similar, the increased force may cause the bicycle frame 112 to shift forward, with the front portion of the frame 112 horizontally translating forward as shown by arrow 134 and the rear portion of the frame 112 generally pivoting forward as shown by arrow 132. As the cyclist thereafter settles in to a steady pace or begins coasts or the like, the bicycle frame 112 returns to an equilibrium position via a force imparted on the support frame 136 by the spring and damper assembly 138, with the front portion of the bicycle frame 112 horizontally translating rearward as shown by arrow 134 and the rear portion of the bicycle frame 112 generally pivoting rearward as shown by arrow 132. Similarly, as the cyclist shifts weight, changes gears, or otherwise moves during a training session, the rear portion of the bicycle frame 112 may pivot backward and forward as shown by arrow 132 while the front portion of the bicycle frame 112 may horizontally translate backward and forward as shown by arrow 134, eventually returning to an equilibrium position via the force imparted on the support frame 136 by the spring and damper assembly 138. In this regard, the bicycle frame 112 has a bit of give when attached to the trainer 114 and dynamically responds to a cyclist's actions, resembling an on-road experience.

Figure 3A:
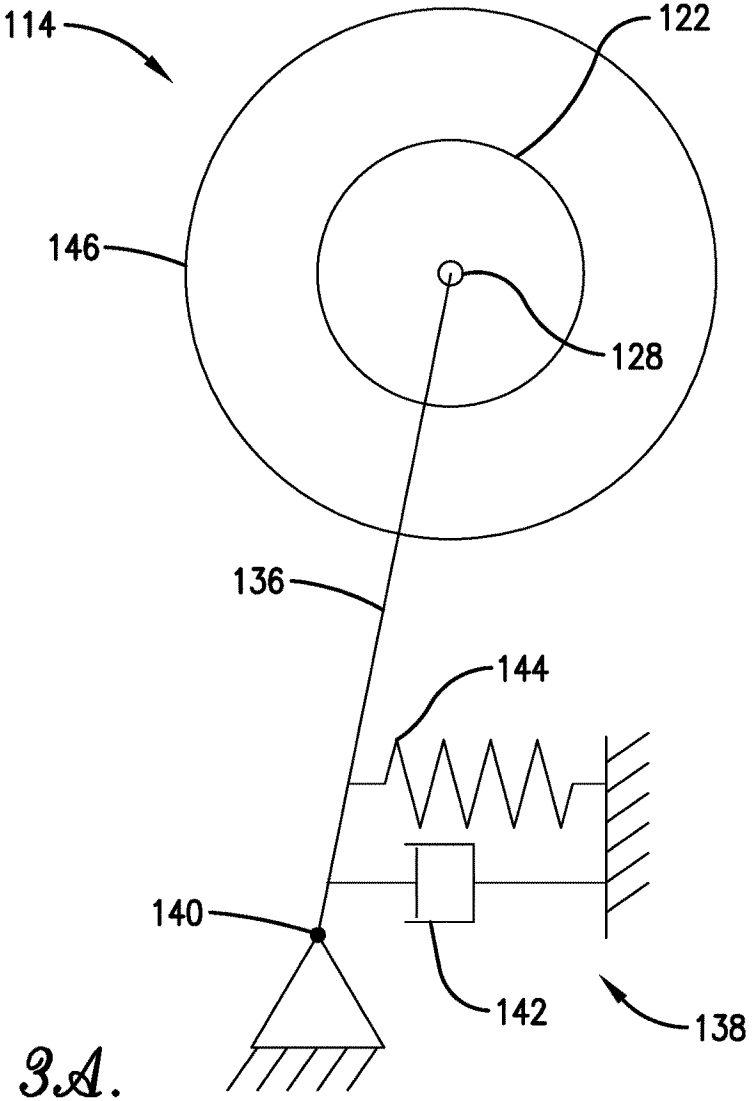
FIG. 3A is a close-up, right-side elevation view of a portion of a bicycle trainer of the bicycle training system shown in FIG. 2.

Turning now to FIGS. 3A-3B, the internal components of the bicycle trainer 114 are shown in more detail. First, as shown in FIG. 3A, the spring and damper assembly 138 generally includes a linear damper 142 and a linear spring 144. When no external force is applied to the support frame 136, the frame 136 (and thus rear axle 128, which is operatively connected to the frame 136) is kept in an equilibrium position via a force applied to the support frame 136 via the linear spring 144. When an external force greater than the spring force is applied to the support frame 136, the frame 136 is pivotably displaced from this equilibrium position. For example, as a cyclist bears down on the pedals, the bicycle frame 112 may translate forward with the support frame 136 pivoting forward accordingly. This compresses the linear spring 144, thereby increasing the spring force applied to the support frame 136. At the same time, the linear damper 142 acts in concert with the linear spring 144, thereby reducing oscillations that may otherwise occur in the bicycle trainer 114. As the external force is decreased by, for example, the cyclist letting up on the pedals or shifting their weight, the spring force from the linear spring 144 in turn forces the support frame 136 back to the equilibrium position, with the linear damper 142 in turn damping any oscillations that may otherwise occur. In this regard, the bicycle frame 112 moves and responds to a cyclist's inputs in a similar manner as the bicycle would when used on the road. In other embodiments, the spring 144 may elongate (rather than compress) in response to the movement of the support frame 136 thereby increasing the spring force, and thereafter the spring may pull (rather than push) the support frame 136 back to the equilibrium position without departing from the scope of this invention.

As best understood with reference to FIG. 3B, the bicycle trainer 114 generally includes a resistance applying mechanism such as a rotor 146 and stator 148 assembly, with the rear axle 128 extending through a central axis of the rotor 146 and stator 148 and operatively connected to the support frame 136. The rotor 146 integrally includes the cassette 122, and thus rotates in response to a cyclist turning the pedals of the bicycle, which are coupled to the rear cassette 122 (and thus the rotor 146) via a front crankset and the chain 124. The rotor 146 and stator 148 may include electromagnets, generators, or the like that can be used to alter the rotational resistance applied to the rotor 146 and thus the pedals of the bicycle frame 112. For example, to simulate a hill or to otherwise increase resistance during a training program, the bicycle trainer 114 may increase the rotational resistance on the rotor 146 by increasing electricity flow to the stator 148's electromagnets, generators, or other braking elements. In response to the increased resistance, the cyclist may in turn increase the force applied to the pedals, stand up on the pedals or otherwise shift their weight, and/or shift between sprockets on the rear cassette 122. Such increase in force and/or weight shift applied to the bicycle frame 112 may in turn cause a shift of the bicycle frame 112 forward via the front wheel horizontally translating (arrow 134) and the rear portion of the frame 112 pivoting forward (arrow 132), compressing the linear spring 144. Once the cyclist begins to coast or the like in response to a subsequent decrease in resistance on the rotor 146, the linear spring 144 returns the support frame 136 to the equilibrium position. In this regard, pivotably mounting the rear portion of the bicycle frame 112 via the support frame 136 and spring and damper assembly 138 provides forward and reward movement of the bicycle frame 112, simulating and replicating outdoor use. Other suitable resistance applying mechanisms may be implemented by other embodiments such as, for example, a mechanical clutch, a mechanical braking system such as a disc or drum brake system, or any other suitable system that dynamically alters the amount of resistance applied to the chain 124 and thus pedals of the bicycle frame 112.

Figure 4:
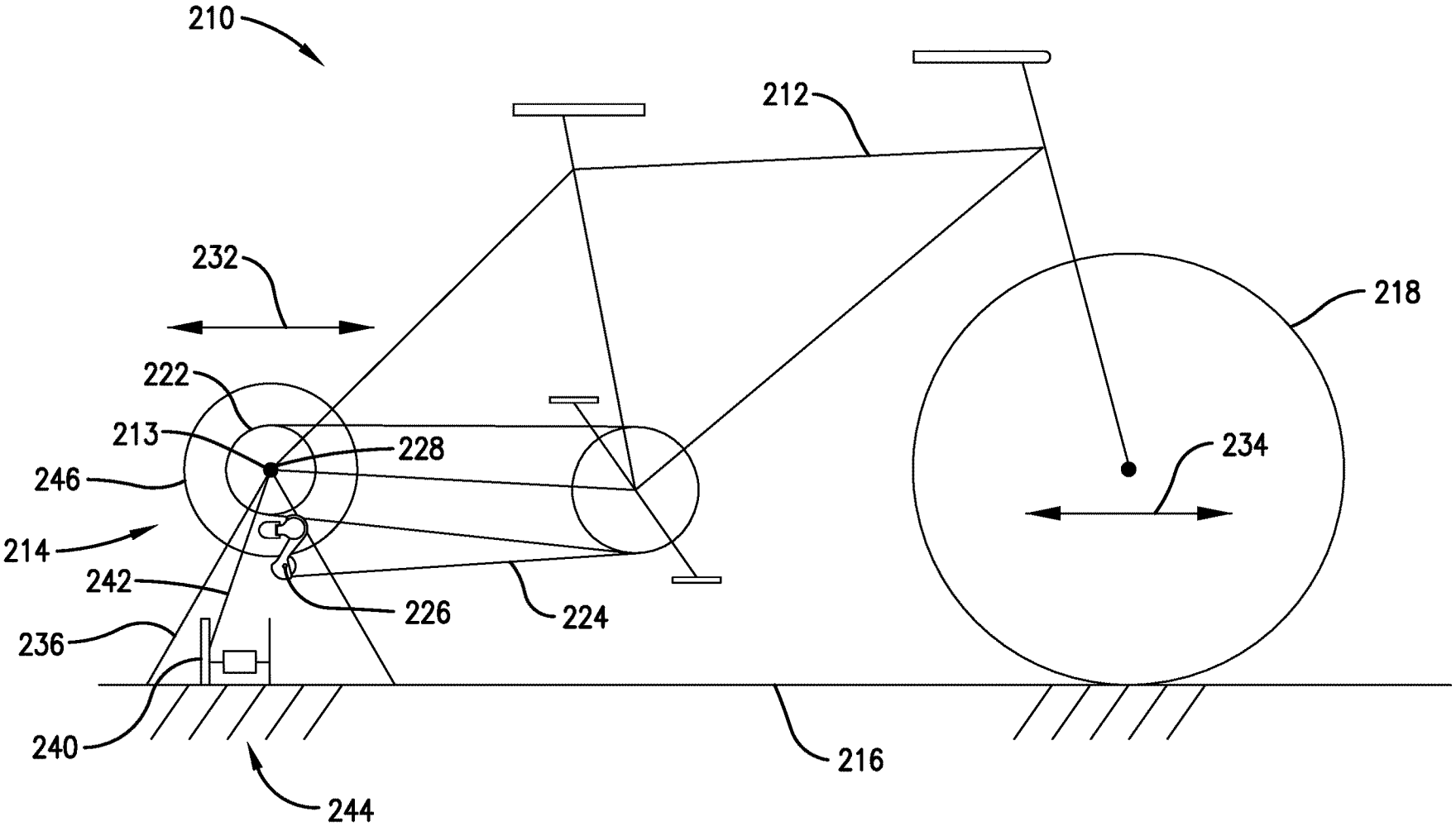
FIG. 4 is a right-side elevation view of a bicycle training system according to a second embodiment of the invention.
Figure 5:
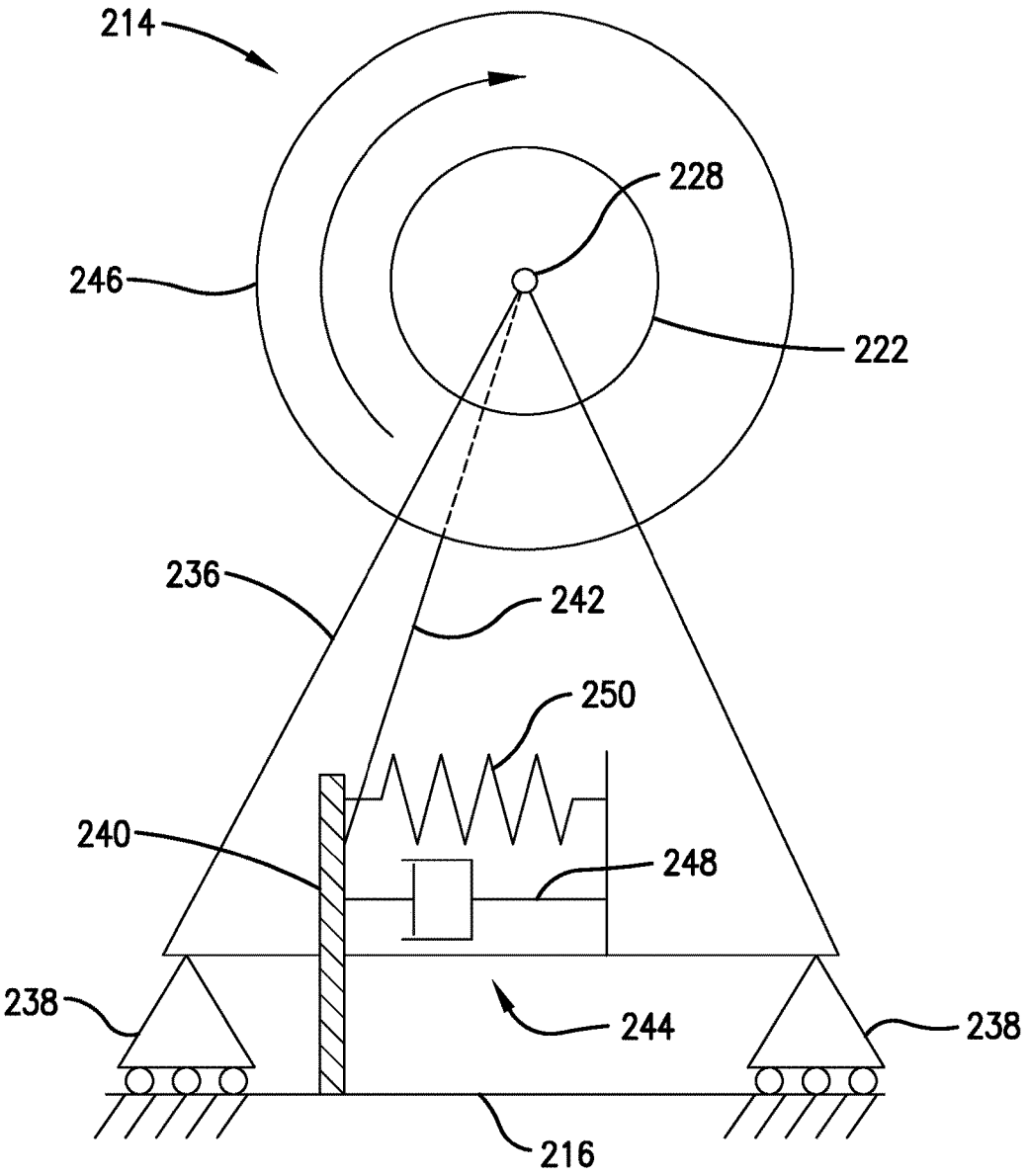
FIG. 5 is a close-up, right-side elevation view of a portion of a bicycle trainer of the bicycle training system shown in FIG. 4.

Although FIGS. 2-3B depict a dynamic bicycle trainer 114 that implements a pivotable support frame 136 connected via a spring and damper assembly 138, other embodiments implement alternative dynamic assemblies without departing from the scope of the invention. For example, FIGS. 4-5 show a dynamic bicycle training system 210 that includes a spring and damper assembly 238 similar to the bicycle training system 110, but in which, unlike the system 110, both the front and rear portions of the bicycle frame 112 horizontally translate rather than any portion pivotably moving in response to the cyclist's activity.

The bicycle training system 210 includes a bicycle frame 212 operatively coupled to a bicycle trainer 214. Again, in the depicted embodiment the front wheel 218 of the bicycle frame 212 is configured to roll about the support surface 216, but in other embodiments the front wheel 218 could be coupled to a translating sled or the like without departing from the scope of the invention. The bicycle trainer 214 operatively couples to a rear portion of the bicycle frame 212 near a rear axle 228 area of the frame 212. Again, the trainer 214 could also include additional components such as a screen or other user interface (similar to screen 20 shown in FIG. 1).

As with the front wheel 118 of the bicycle training system 110 shown in FIG. 2, the front wheel 218 of the bicycle training system 210 is permitted to move forwards and backwards during use of the bicycle training system 210, as schematically depicted by arrow 234. The bicycle trainer 214 generally includes a rear cassette 222 mounted to a rotor 246, a support frame 236, near-frictionless sliders 238 provided between the support frame 236 and the support surface 216, a pushing block 240 and/or pushing rod 242, and a spring and damper assembly 244 operatively connecting the support frame 236 to the pushing block 240 and/or pushing rod 242. The bicycle trainer 214 engages a rear portion of the bicycle frame 212 such as a rear axle 228, the rear dropouts 213 of the frame 212, or other portion of the stays of the bicycle frame 212. More particularly, and in a similar fashion to the embodiment discussed in connection with FIG. 2, to mount the bicycle frame 212 to the bicycle trainer 214, the cyclist removes a rear wheel and cassette of the bicycle frame 212, secures the a rear portion of the frame (for example, the rear dropouts 213) to the bicycle trainer 214 via a rear axle 228, and then places the chain 224 around a sprocket of the rear cassette 222, thereby operatively connecting the pedals and crankset to the rear cassette 222 and thus rotor 246 of the bicycle trainer 214. Once mounted in this regard, the cyclist can spin the rotor 246 by pedaling the bicycle and shift the chain 224 among the sprockets of the rear cassette 222 of the trainer 214 via a shifter lever operatively connected to a rear derailleur 226 via a cable.

As schematically depicted by arrow 232, and unlike the bicycle trainer 114 of the previous embodiment, the bicycle trainer 214 of the bicycle training system 210 engages the rear portion of the bicycle frame 212 in a horizontally translatable manner. More particularly, the support frame 236 includes near-frictionless sliders 238 that translate back and forth, and thus in turn move the rear portion of the bicycle frame 212 back and forth in response to the cyclist's inputs. That is, as a cyclist uses the bicycle training system 210, the bicycle frame 212 is permitted to dynamically respond to the cyclist's inputs on the pedals, weight shifts, and other changes during the training session by the entirely of bicycle frame 212 horizontally translating forward and backward as depicted by arrows 232 and 234, simulating an on-road experience.

For example, as the cyclist bears down on the pedals in order to increase speed, respond to an increase in resistance from the bicycle trainer 214, or otherwise, the increased force may cause the bicycle frame 212 to shift forward, with the front portion of the frame horizontally translating forward as shown by arrow 234 and the rear portion of the frame horizontally translating forward as shown by arrow 232. As the cyclist thereafter settles in to a steady pace or else coasts or the like, the bicycle frame 212 returns to an equilibrium position via a force imparted on the support frame 236 (and more particularly a pushing block 240 and/or pushing rod 242 attached thereto) by the spring and damper assembly 244, with the front portion of the bicycle frame 212 horizontally translating rearward as shown by arrow 234 and the rear portion of the bicycle frame 212 horizontally translating rearward as shown by arrow 232. Similarly, as the cyclist shifts weight during a training session, the rear portion of the bicycle frame 212 horizontally translates backward and forward as shown by arrow 232 while the front portion of the bicycle frame 212 horizontally translates backward and forward as shown by arrow 234, eventually returning to an equilibrium position via the force imparted on the support frame 236 by the spring and damper assembly 244.

Turning now to FIG. 5, the internal components of the bicycle trainer 214 are shown in more detail. Similar to the spring and damper assembly 138 discussed above, the spring and damper assembly 244 of the bicycle trainer 214 generally includes a linear damper 246 and a linear spring 248. When no external force is applied to the support frame 236, the frame 236 (and thus rear axle 228, which is operatively connected to the frame 236) is kept in an equilibrium position via a force applied to the support frame 236 via the linear spring 248. When an external force greater than the spring force is applied to the support frame 236 by the cyclist using the training system 210, the frame 236 horizontally displaces from this equilibrium position. For example, as a cyclist bears down on the pedals, the bicycle frame 212 may translate forward with the support frame 236 horizontally translating forward accordingly. This extends the linear spring 248, thereby increasing the spring force applied to the support frame 236. At the same time, the linear damper 246 acts in concert with the linear spring 248, thereby reducing oscillations that may otherwise occur in the bicycle trainer 214. As the external force is decreased by, for example, the cyclist letting up on the pedals or shifting their weight, the spring force from the linear spring 248 in turn forces the support frame 236 back to the equilibrium position, with the linear damper 246 in turn damping any oscillations that may otherwise occur. In this regard, the bicycle frame 212 moves and responds to a cyclist's inputs in a similar manner as the bicycle would when used on the road. The near-frictionless sliders 238 may be configured to enable a minimum amount of movement, e.g., 3 cm, which is capable for simulating a mountain road climb of 20%. The particular deflection of the sliders depends on the way the cyclist applies force to the pedals and his or her pedaling cadence.

Figure 6:
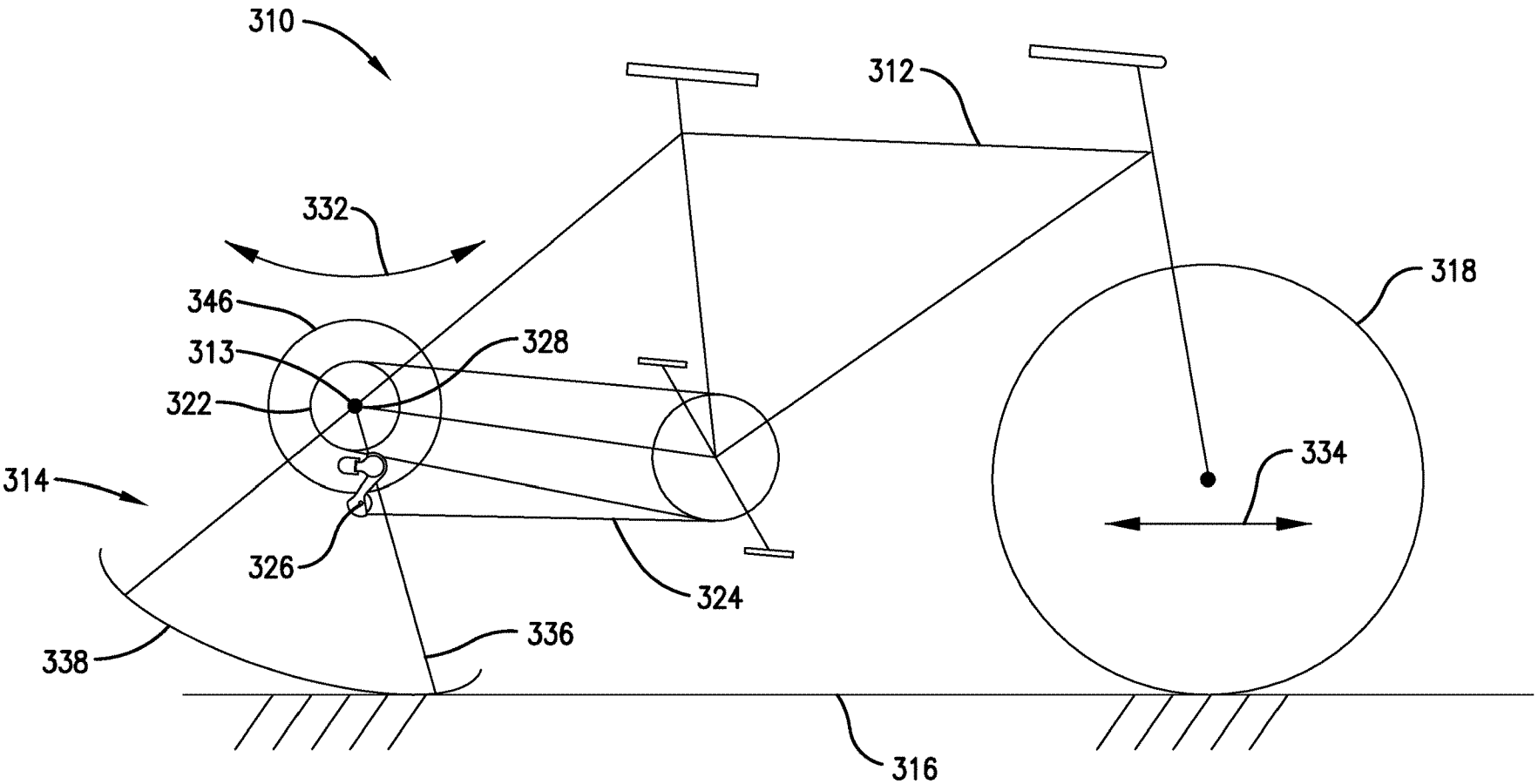
FIG. 6 is a right-side elevation view of a bicycle training system according to a third embodiment of the invention.

FIGS. 6-7 show yet another embodiment of a dynamic bicycle training system 310 according to aspects of the invention, but in which, unlike the systems 110 and 210, the rear portion of a bicycle frame 312 moves in a generally rocking motion, as depicted by the arcuate arrow 332. More particularly, the bicycle training system 310 does not include a spring and damper assembly at all but rather includes an arcuate floorboard 338 that generally rocks back and forth in response to a cyclist's inputs on the pedals or the like, and which is returned to an equilibrium position via gravity.

The bicycle training system 310 includes a bicycle frame 312 operatively coupled to a bicycle trainer 314. As with the bicycles training systems 110 and 210, the bicycle trainer 314 operatively couples to a rear portion of the bicycle frame 312 while a front wheel 218 of the bicycle frame is allowed to roll about a support surface or else is supported via a sled or the like (not shown) in a horizontally translatable manner. Again, the trainer 314 could also include additional components such as a screen or other user interface, similar to the screen 20 shown in FIG. 1.

The bicycle trainer 314 generally includes a rear cassette 322 coupled to a rotor 346, a support frame 336, and an arcuate floorboard 338 provided at the bottom of the support frame 336 and which rests upon a support surface 316 when the bicycle trainer 314 is in use. The bicycle trainer 314 engages a rear portion of the bicycle frame 312 such as a rear axle 328, the rear dropouts 313 of the frame, or other portion of the stays of the bicycle frame 312. More particularly, and in a similar manner as discussed with respect to trainers 114 and 214, to mount the bicycle frame 312 to the bicycle trainer 314, the cyclist removes a rear wheel and cassette of the bicycle frame 312, secures the a rear portion of the frame (for example, the rear dropouts 313) to the bicycle trainer 314 via a rear axle 328, and then places the chain 324 around a sprocket of the rear cassette 322. Once mounted in this regard, the cyclist can spin the rotor 346 by pedaling the bicycle and switch between sprockets on the cassette 322 via a shift lever on the bicycle frame 312.

As schematically depicted by arrow 332, the bicycle trainer 314 engages the rear portion of the bicycle frame 312 in a rocking manner. More particularly, the support frame 336 is rotatably mounted to the bicycle frame 312 at the rear axle 328 area, with the opposite end of the support frame 336 fixedly coupled to a floorboard 338. In response to a cyclist increasing force, shifting weight, or switching gears, the frame 336 rocks about the generally arcuate floorboard 338. As a cyclist uses the bicycle training system 310, the bicycle frame 312 is permitted to dynamically respond to the cyclist's inputs on the pedals, weight shifts, and other changes during the training session by the front wheel 318 horizontally translating back and forth as depicted by arrow 334 and the rear portion of the frame 312 moving in a generally U-shaped, rocking pattern as schematically represented by arrow 332.

For example, as the cyclist bears down on the pedals in order to increase speed, respond to an increase in resistance from the bicycle trainer 314, or otherwise, the cyclist's increased effort may cause the bicycle frame 312 to shift forward, with the front portion of the frame horizontally translating forward as shown by arrow 334 and the rear portion of the frame rocking forward as shown by arrow 332. In this position the bicycle trainer 114's center of gravity will be shifted forward of an equilibrium position. As the cyclist thereafter settles in to a steady pace or else coasts or the like, the bicycle frame 312 returns to an equilibrium position via gravity rocking the support frame 336 back to an upright position via the front portion of the bicycle frame 312 horizontally translating rearward as shown by arrow 334 and the rear portion of the bicycle frame 312 rocking backward in a generally arcuate manner as shown by arrow 332.

Figure 7B:
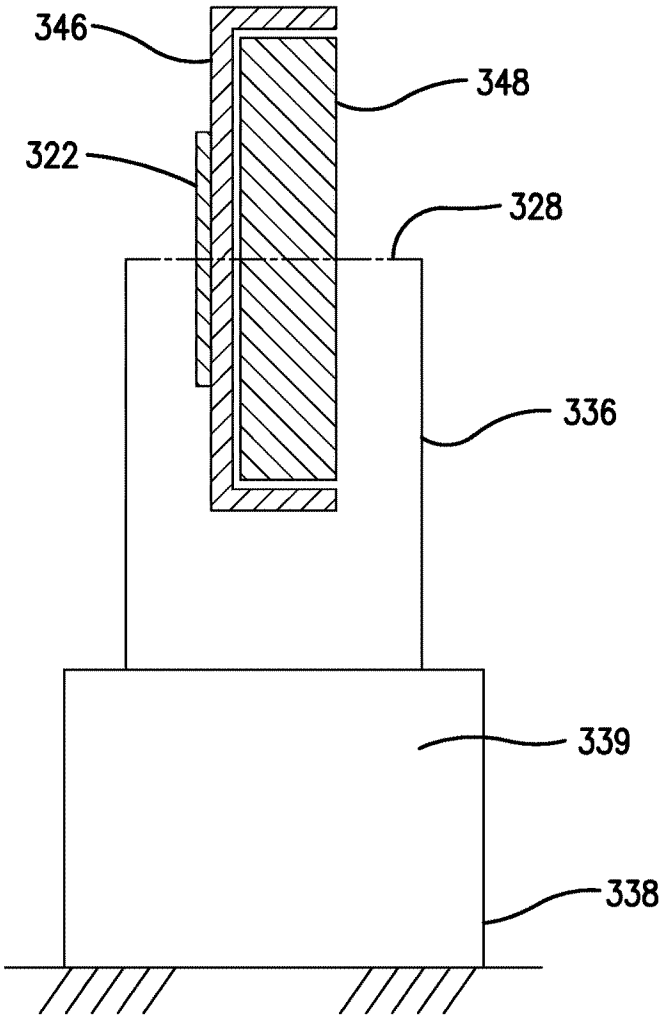
FIG. 7B is a front view of the portion of the bicycle trainer shown in FIG. 7A.
Figure 7A:
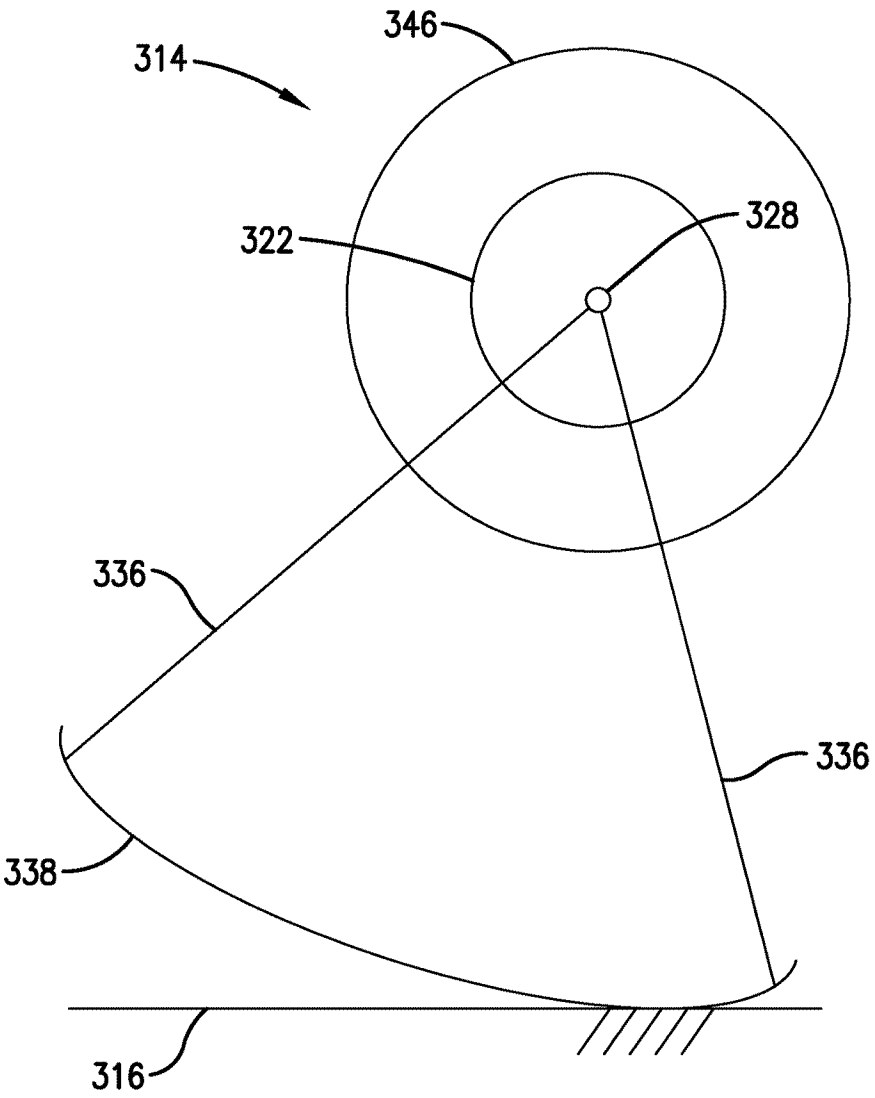
FIG. 7A is a close-up, right-side elevation view of a portion of a bicycle trainer of the bicycle training system shown in FIG. 6.

Turning now to FIGS. 7A and 7B, components of the bicycle trainer 314 are shown in more detail. As seen in FIG. 7A, dual support rods of the support frame extend from the rear axle 328 to the generally arcuate floorboard 338. The arcuate floorboard 338 includes a generally convex outer surface 339 that faces and thus engages the support surface 316 in a rocking manner, much like the rockers or runners of a rocking chair. As best understood with reference to FIG. 7B, the rear axle 328 extends through a central axis of the rotor 346 and stator 348 assembly as one example of a resistance applying mechanism that may be employed within the bicycle trainer 314, which operate in a similar manner as the rotor 146 and stator 148 of the bicycle trainer 314 depicted in FIGS. 2-3B and thus will not be discussed again in detail. And again, other suitable resistance applying mechanisms may be implemented such as, for example, a mechanical clutch, a mechanical braking system such as a disc or drum brake system, or any other suitable system that dynamically alters the amount of resistance applied to the chain 324 and thus pedals of the bicycle frame 312. Based on forces applied to the pedals, the floorboard 338 "walks" forward or backward to impart motion to the cyclist. Such a configuration eliminates the complex hardware that can be utilized by examples of the embodiments illustrated in the previous embodiments. The floorboard 338 acts as a spring when the bicycle trainer 314 oscillates by the cycling motion.

Figure 8:
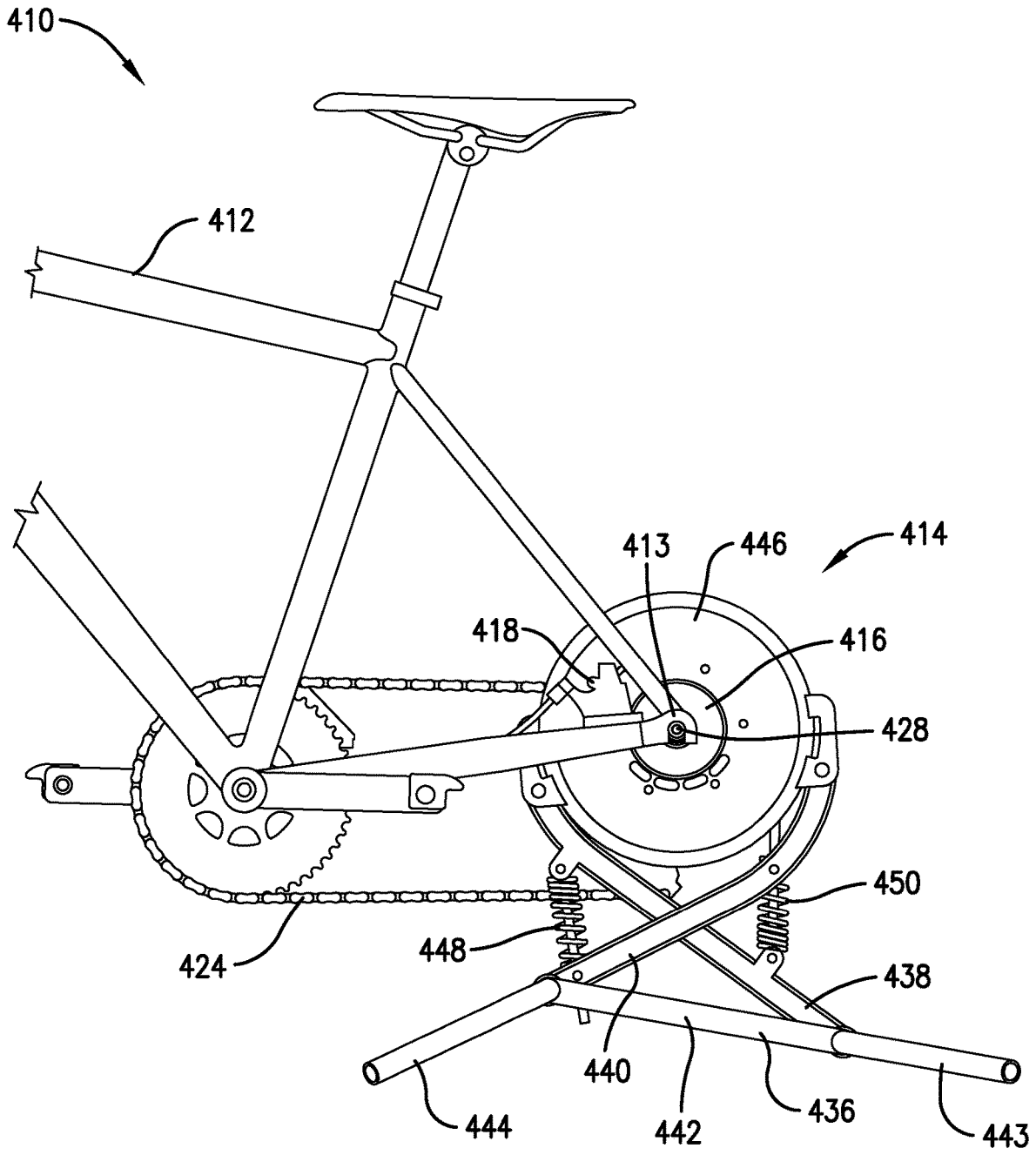
FIG. 8 is a right-side elevation view of a bicycle training system according to various embodiments of the invention.
Figure 9:
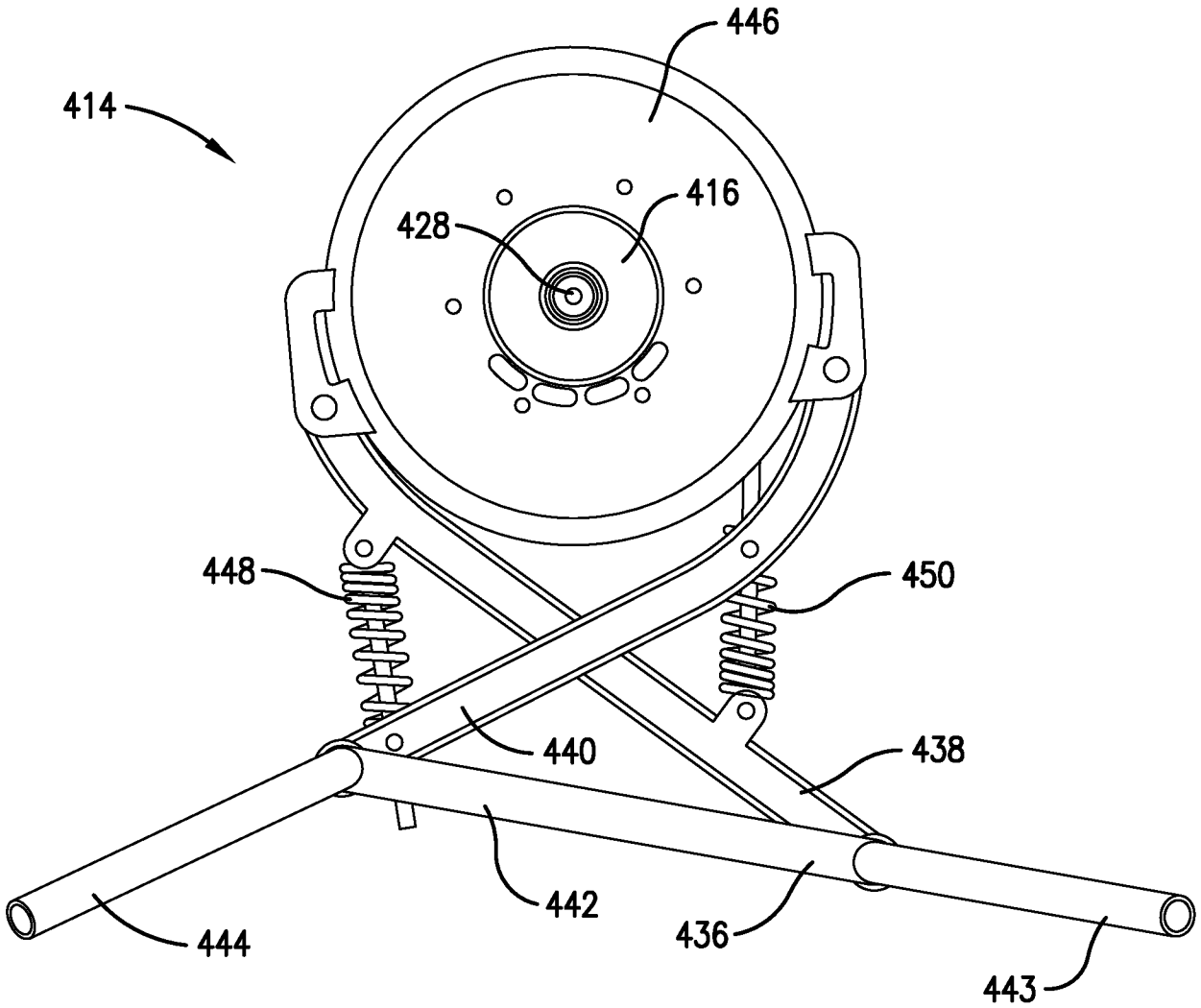
FIG. 9 is a perspective view the trainer of FIG. 8.

Referring to FIGS. 8-9, another example configuration of a bicycle training system 410 is illustrated. As with the bicycles training systems 110, 210, and 314 described above, the system 410 includes bicycle trainer 414 that operatively couples to a rear portion of the bicycle frame 412, such as rear axle 428, while a front wheel of the bicycle frame is allowed to roll about a support surface or else is supported via a sled or the like (not shown) in a horizontally translatable manner. The system 410 can also include additional components such as a screen or other user interface, similar to the screen 20 shown in FIG. 1. Trainer 414 is coupled to bicycle frame 412 in a similar manner to that described above with respect to the other disclosed configurations. The bicycle trainer 414 generally includes a rotor 446, a support frame 436, legs 438, 440, base 442, stands 443, 444, and spring assemblies 448, 450. Brake actuator 418 is configured to apply a braking force and/or resistance to brake disk 416. The bicycle trainer 414 may additionally or alternatively engage rear dropouts 413 of the bicycle frame. In a similar manner as discussed with respect to trainers 114, 214, and 314, to mount the bicycle frame 412 to the bicycle trainer 414, the cyclist removes a rear wheel and cassette of the bicycle frame 412, secures a rear portion of the frame (for example, the rear dropouts 413) to the bicycle trainer 414 via a rear axle 428, and then places the chain 424 around a sprocket of the rear cassette. Once mounted in this regard, the cyclist can spin the rotor 446 by pedaling the bicycle and switch between sprockets on the cassette via a shift lever on the bicycle frame 412 that engages rear derailleur 426. Legs 438, 440 are configured to pivot forward and backward to impart motion to the cyclist based on forces force applied to the drivetrain of the bicycle frame 412—e.g., based on forces imparted to the pedals by the cyclist. Spring assemblies 448, 450 function in a similar manner to damper assembly 138 by applying forces to allow the system 410 to return to an equilibrium position.

Various embodiments may provide forward and backward motion, such as those examples shown in FIGS. 2-9, may be utilized in combination with systems that provide left/right motion to the cyclist. Thus, for example, forces may be imparted to the cyclist in the forward (front), backward (rear), left, and right directions to provide improved movement and training functionality. In that regard, embodiments the bicycle trainer may include additional spring and damper assemblies, arcuate floorboards, near-frictionless rollers, or other components that permit movement in a direction generally perpendicular to the movement depicted by the various arrows 132, 134, 232, 234, 332, and 334. For example, when climbing a hill, a cyclist may rock the bicycle frame from side to side as they stand and increase force on the pedals. Thus, in embodiments that permit left/right motion, in additional to the generally horizontal movement of the bicycle frame as discussed above in connection with FIGS. 2-9 the bicycle frame may also move from side to side, providing additional rear-world feel and dynamic feedback to the cyclist.

I claim:

1. A direct-drive bicycle training system comprising:

a bicycle trainer configured to rest on a support surface and support a bicycle frame in an upright manner with respect to the support surface, the bicycle trainer comprising:

a stator;

a rotor configured to rotate with respect to the stator;

a cassette affixed to the rotor and configured to rotate with the rotor;

a support frame including an arcuate floorboard supporting the stator, rotor, and cassette, the arcuate floorboard having a convex outer surface configured to abut the support surface; and a resistance applying mechanism configured to operatively apply varying levels of resistance to the rotor;

wherein the convex outer surface of the arcuate floorboard is configured to rock forward and backward on the support surface in response to a force applied to the bicycle frame during use of the bicycle training system.

2. The direct-drive bicycle training system of claim 1, wherein the support frame is configured to pivot with respect to the support surface in response to the force applied to the bicycle frame.

3. The direct-drive bicycle training system of claim 1, wherein the support frame is configured to horizontally translate with respect to the support surface in response to the force applied to the bicycle frame.

4. The direct-drive bicycle training system of claim 1, wherein the bicycle trainer is further configured such that a center of gravity of the bicycle trainer moves in response to movement of the bicycle frame via rocking of the floorboard about the support surface in a first direction.

5. The direct-drive bicycle training system of claim 4, wherein the bicycle trainer is further configured such that center of gravity of the bicycle trainer returns to an equilibrium position via rocking of the floorboard about the support surface in a second direction opposite to the first direction.

6. A method of training using a direct-drive bicycle training system comprising:

resting a bicycle trainer on a support surface, the bicycle trainer comprising:

a stator;

a rotor configured to rotate with respect to the stator;

a cassette affixed to the rotor and configured to rotate with the rotor; and a support frame including an arcuate floorboard supporting the stator, rotor, and cassette, the arcuate floorboard having a convex outer surface configured to abut the support surface;

supporting, with the bicycle trainer, a bicycle frame in an upright manner with respect to the support surface;

operatively coupling a portion of the bicycle frame to the bicycle trainer;

applying varying levels of resistance to the rotor using the bicycle trainer; and rocking the convex outer surface of the arcuate floorboard forward and backward on the support surface in response to a force applied to the bicycle frame during use of the bicycle training system.

7. The method of claim 6, wherein operatively coupling the portion of the bicycle frame to the bicycle trainer comprises operatively coupling a bicycle chain of the bicycle frame to the cassette of the bicycle trainer.

8. The method of claim 6 further comprising pivoting or horizontally translating the support frame with respect to the support surface in response to the force applied to the bicycle frame.

* * * * *